US006363588B1

(12) United States Patent
Caradine

(10) Patent No.: US 6,363,588 B1
(45) **Date of Patent: *Apr. 2, 2002**

(54) BAG CLAMP

(76) Inventor: James Grant Caradine, 148 S. Nardo St., Solana Beach, CA (US) 92075

( * ) Notice: Subject to any disclaimer, the term of this patent is extended or adjusted under 35 U.S.C. 154(b) by 0 days.

This patent is subject to a terminal disclaimer.

(21) Appl. No.: 09/569,210

(22) Filed: May 11, 2000

Related U.S. Application Data

(63) Continuation-in-part of application No. 09/310,623, filed on May 12, 1999, now Pat. No. 6,105,217.

(51) Int. Cl.[7] ..... A44B 21/00; B65D 37/00; B65D 77/10

(52) U.S. Cl. ..... 24/501; 24/30.5 R; 24/502; 24/543

(58) Field of Search ..... 24/501, 500, 502, 24/543, 30.5 R, 30.5 P

(56) References Cited

U.S. PATENT DOCUMENTS

| | | | | | |
|---|---|---|---|---|---|
| 381,265 | A | | 4/1888 | Martens | 24/30.5 R |
| 405,518 | A | | 6/1889 | Wilson | 24/30.5 R |
| 2,679,098 | A | | 5/1954 | Diecken | |
| 3,823,443 | A | * | 7/1974 | Takabayashi | 24/186 |
| 3,825,012 | A | | 7/1974 | Nicoll | 24/543 |
| 4,038,726 | A | * | 8/1977 | Takabayashi | 24/186 |
| 4,360,970 | A | | 11/1982 | Ostrroski et al. | 30/2 |
| 4,394,791 | A | | 7/1983 | Groth | 24/30.5 R |
| 4,428,098 | A | | 1/1984 | Coker et al. | 24/30.5 R |
| 4,660,750 | A | | 4/1987 | Blanchard | 24/501 |
| 4,711,031 | A | | 12/1987 | Annello | 30/294 |
| 4,736,925 | A | | 4/1988 | Kamstrup-Larsen et al. | 251/10 |
| 4,847,956 | A | | 7/1989 | Levine | 24/30.5 R |
| 5,007,171 | A | | 4/1991 | Horning, Jr. | 30/294 B |
| 5,123,146 | A | * | 6/1992 | Olson | 24/30.5 R |
| 5,305,500 | A | | 4/1994 | Tucker | 24/30.5 R |
| 5,318,292 | A | | 6/1994 | DeMarco | 273/32 |
| 5,428,871 | A | | 7/1995 | Iosif | 24/30.5 R |
| 5,457,858 | A | | 10/1995 | Lin | 24/511 |
| 5,752,319 | A | | 5/1998 | Su et al. | 30/361 |
| 5,802,677 | A | | 9/1998 | Dorman et al. | 24/30.5 R |

FOREIGN PATENT DOCUMENTS

| | | | |
|---|---|---|---|
| EP | 0156779 | 10/1985 | 24/30.5 R |

* cited by examiner

*Primary Examiner*—Victor N. Sakran
(74) *Attorney, Agent, or Firm*—William Patrick Waters

(57) ABSTRACT

A clamp for closing a polymer bag, including a pair of opposed clamp members wherein said clamp members are movable between a closed and an opened condition, each one of said pair of clamp members having a long axis and an inner and an outer surface. A hinge attaches the pair of clamp members and biases the clamp members into a closed condition. In holding a bag in a closed condition, a blade disposed on the inner surface of one of the clamp members is urged by the hinge against and an opposed recessed anvil, disposed on the inner surface of the other clamp member. In addition, a plurality of ribs disposed parallel to the clamp member long axis and located on the inner surface of each one of said pair of clamp members aid in gripping the bag within the clamp by intercalation of the ribs of one clamp with those of the other clamp. During the bag opening process, the ribs stretch the bag material for effective cutting when the material is moved past the blade.

17 Claims, 3 Drawing Sheets

BAG CLAMP

CROSS-REFERENCE TO RELATED APPLICATION

This is a continuation in part patent application of patent application Ser. No. 09/310,623, titled "Bag Clamp", filed May 12, 1999, now U.S. Pat. No. 6,105,217.

BACKGROUND OF THE INVENTION

The present invention relates generally to devices for use with bags containing foods, potting soil compositions and the like and, more particularly, to clamps useful for closing, and opening, such bags.

As stated in the parent application, modem polymer bags afford significant protection to their contents and are generally economical in use. As a result, they are used for a variety of products ranging from foods such as potato chips, in relatively small and light bags, to potting soil compositions that are sold in large and relatively heavy bags.

The bags are generally of polymer construction with polypropylene and polyethylene compositions being often favored. These compositions tend to produce a bag that is impervious to environmental conditions such as pests and moisture. However, the bags often have slippery surfaces. This surface characteristic challenges inventors of bag closure devices since an effective bag closure device should effectively reclose the polymer bag, in spite of the slippery nature of the bag surface. In view of the challenge the polymer bag presents, a suitable closure device should protect bag contents by providing effective sealing of the bag. Desirably, the device would be inexpensive to manufacture and constructed of readily available materials.

Some conventional bag closure devices utilize latching mechanisms to hole together opposing jaws and such devices tend to be cumbersome in use and, if the latch slips, ineffective in operation. Thus, the clamp should actively hold the bag, preferably without a latching device.

In many cases, polymer bags are intended for repetitive use wherein the bag is opened, some contents are removed, and the bag is reclosed. Generally, it is important that the bag be securely closed. In the case of foods such as potato chips, for example, after the bag has been opened and some chips removed, it is desirable to have a technique for closing the bag to preserve freshness of the product and to prevent ants or other pests from gaining access to the chips. Thus, it is desirable to have an effective, easily used polymer bag closing device.

When heavier polymer bags, containing potting soil, for example, are utilized, a sturdy bag closing device is required. Desirably, the closure device would be of a type that does not become dislodged easily. Conventional clamping devices sometimes fail this test because they concentrate gripping forces near the clamp center. Movement of the heavy bag results in slippage of the bag at the clamp edges with spillage of bag contents sometimes resulting. This is due, in part, to the weight of the bag which, together with a slippery texture, can cause the bag to tear free of the clamping device.

Several conventional devices have been used to close polymer bags. Such devices are utilized, not only for closing food containers but also as clamping devices for garments and the like. In general, these devices have some utility but can be complicated and at least in some cases, they tend to slip, especially when heavy bags, such as potting soil bags are involved.

Accordingly, there is a need for an efficient, low cost and effective device for sealing a modem polymer bag. Such a device could be adapted for small bags and large while affording a substantial amount of purchase against the slippery surface of the bag, even at the edges of the device.

From the foregoing it will be apparent that there is a need for a polymer bag closure device that is reliable, effective, mechanically simple, easy to use and low in cost. In addition to these characteristics, it would be highly desirable if such a device could have utility in opening polymer bags in an effective manner.

The above having been said, another aspect of polymer bags deserves consideration. These bags are notoriously difficult to open. This is due, in part, to the strength of the synthetic material and effective sealing of the bag during the bag packing process. The result is a bag that can cause substantial difficulty as a consumer attempts to open it. In some typical cases, the consumer attempts forcefully to separate sealed bag surfaces. All too frequently, this action causes a rupture of the bag seal, destruction of the bag itself, and unwanted broadcast of breakfast cereal throughout a kitchen.

Clearly a need exists for an effective polymer bag clamping device having the above described characteristics. Desirably, such a bag clamp would be useful also for opening such a bag, in a convenient manner.

DISCLOSURE OF THE INVENTION

According to the present invention, there is provided a clamp for closing a polymer bag, including a pair of opposed clamp members wherein said clamp members are movable between a closed and an opened condition, each one of said pair of clamp members having a long axis and an inner and an outer surface. A hinge attaches the pair of clamp members and biases the clamp members into a closed condition. In holding a bag in a closed condition, a blade disposed on the inner surface of one of the clamp members is urged by the hinge against and an opposed recessed anvil, disposed on the inner surface of the other clamp member. In addition, a plurality of ribs disposed parallel to the clamp member long axis and located on the inner surface of each one of said pair of clamp members aid in gripping the bag within the clamp by intercalation of the ribs of one clamp with those of the other clamp. During the bag opening process, the ribs stretch the bag material for effective cutting when the material is moved past the blade.

The present invention affords several advantages. The combination of gripping surfaces on the clamp members provides a capacity for effective and efficient gripping of a polymer bag. Importantly, the blade and opposed, recessed anvil cooperate with the clamp member ribs to aid in distributing gripping forces away from the center of the clamp. Thus, a more efficient clamping capability is provided.

In addition, the parallel, intercalating ribs, disposed on the inner surface of each clamp member, aid in stretching the bag material and thereby facilitate the action of the blade during the bag opening process. In a preferred embodiment of the invention, the clamp is simple in construction and is comprised of readily available plastic materials.

Other aspects and advantages of the present invention will become apparent from the following detailed description, taken in conjunction with the accompanying drawings, illustrating by way of example the principles of the invention.

BEST MODE FOR CARRYING OUT THE INVENTION

Figure 1:
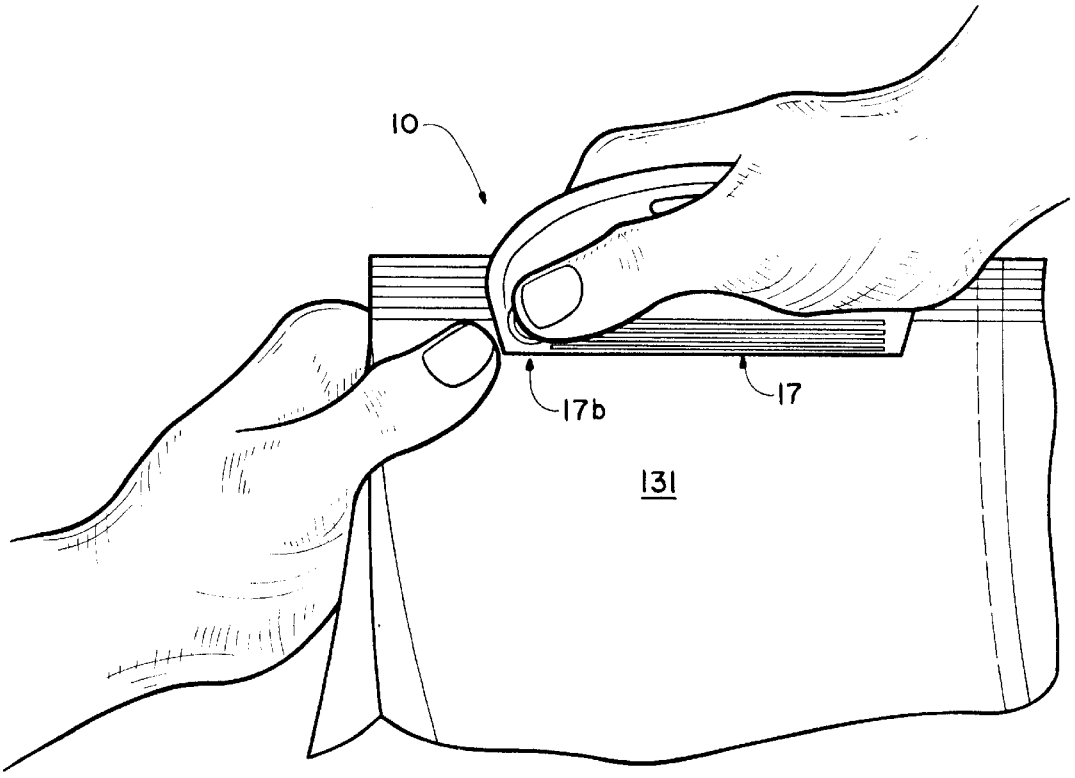
FIG. 1 is an illustrative view of a bag clamp, constructed according to the present invention, showing the clamp in position for closing a polymer bag by gripping action, or for opening the bag by cutting the bag material.
Figure 2:
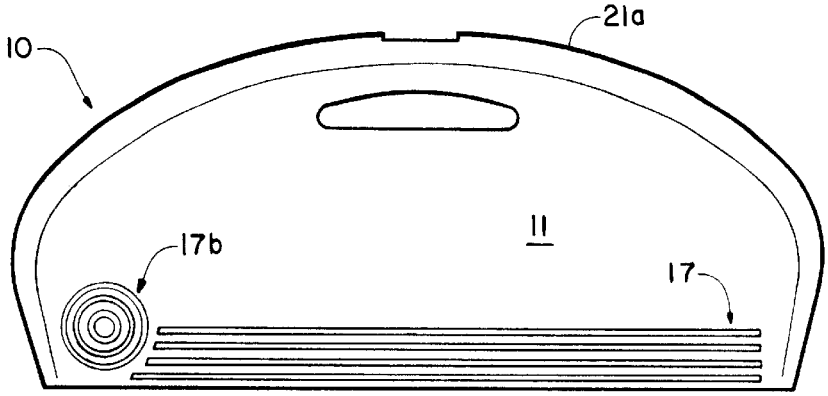
FIG. 2 is a top plan view of the present invention.
Figure 3:
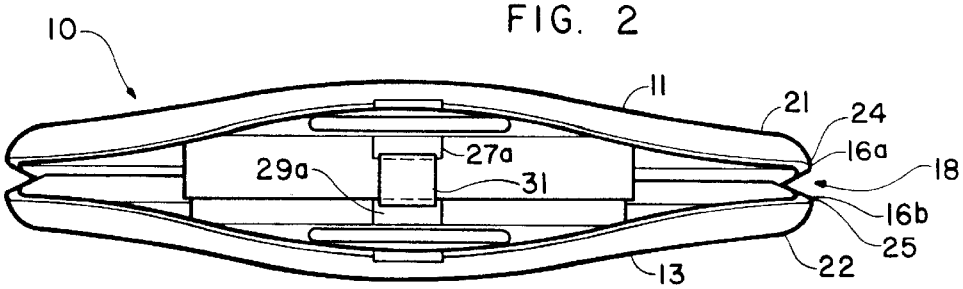
FIG. 3 is an isometric view showing the clamp of the present invention in a closed condition.
Figure 7:
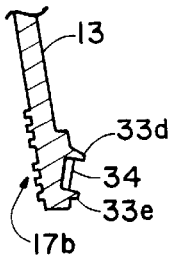
FIG. 7 is a view taken along 7—7 of FIG. 5.
Figure 8:
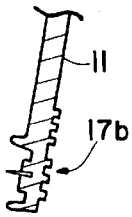
FIG. 8 is a view taken along 8—8 of FIG. 6.
Figure 4:
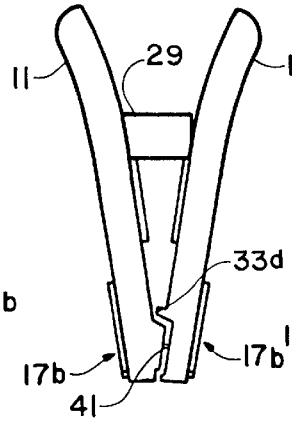
FIG. 4 is a side view of the clamp of the present invention showing the relationship between the blade and the recessed anvil.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

In the following detailed description and in the several figures of the drawings, like elements are identified with like reference numerals. As shown in the drawings for purposes of illustration, the invention is embodied in a novel clamp 10 for closing a modern polymer bag, such as the bag 131. As shown in FIGS. 1–10, the clamp 10 includes an upper clamp member 11 and a lower clamp member 13 that define a bag receiving opening generally indicated by the reference numeral 18. The members 11 and 13 each includes a lip, such as the lips 16*a* and 16*b*, respectively, for aiding in guiding polymer bag 131 into the clamp 10 for either opening or reclosing the bag.

The clamp members 11 and 13 each include a first portion 21 and 22, respectively, for engagement of a polymer bag surface. The first portions end, respectively, in generally straight, elongated, leading edges 24 and 25. Opposite the first portions 21 and 22, the clamp members include a second portion 21*a* and 22*a*, respectively. The second portions 21*a* and 22*a* have a generally arcuate shaped edge that enable easy grasping by a user for installing, or removing the clamp 10 from a polymer bag or for use of the clamp 10 as a bag opening tool. A plurality of parallel ribs, indicated generally by the reference numeral 17, are disposed along the outer surfaces of the clamp members 11 and 13 to aid a user in grasping the clamp 10. In addition, a series of concentric circles, generally indicated by the reference numeral 17*b*, helps the user to grasp the clamp 10, in the manner shown in FIG. 1, while using the device.

An open, box-like structure 29, having a slot 28, is disposed on the inner surface of the clamp member 13. An elongated member 29*a*, fixed to the inner surface of the clamp member 11, is received in the slot 28 for rotational movement therewithin. The elongated member 29*a* and the structure 29 each include openings 27*a* and 29*a*, respectively. A spring clip 31 joins the clamp members 11 and 13 together and biases the leading edges 24 and 25 together. The spring clip 31 includes a pair of legs, such as the leg 31*a*, that are inserted through the openings 27*a* and 29*a* to be retained in sleeves 31*b* and 31*c* on the inner surfaces of the clamps 11 and 13, respectively.

Figure 9:
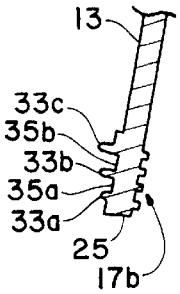
FIG. 9 is a view taken along 9—9 of FIG. 5.
Figure 5:
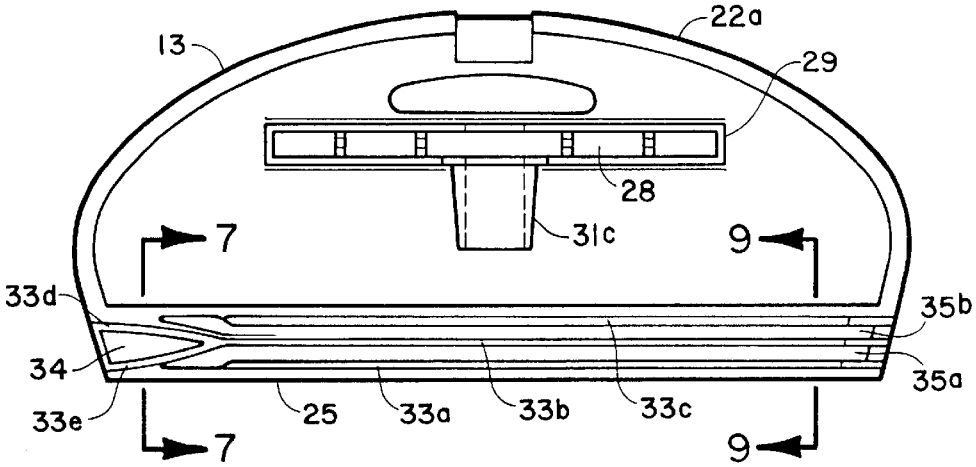
FIG. 5 is an isometric view showing the ribs and recessed anvil of one of the clamp members of the present invention.
Figure 6:
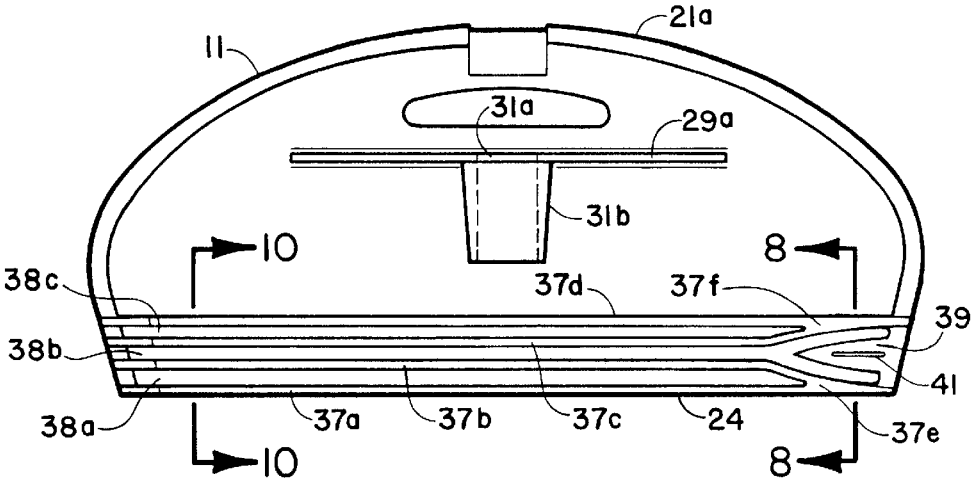
FIG. 6 is an isometric view showing the ribs and the blade of the other one of the clamp members of the present invention.
Figure 11:
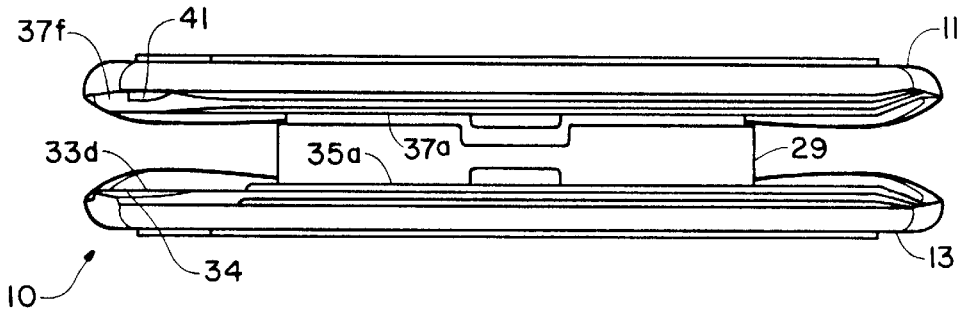
FIG. 11 is a bottom plan view of the clamp member of the present invention showing the relationships among the blade, anvil and interlocking ribs.

Referring now to FIGS. 4, 5, 7 and 9, it will be noted that on the inner surface of the lower clamp member 13, a plurality of elongated ribs 33*a*, 33*b* and 33*c* are disposed parallel to the long axis of the clamp member edge 25. The ribs help define troughs 35*a* and 35*b* wherein the trough 35*a* is located between the ribs 33*a* and 33*b* while the trough 35*b* is located between the ribs 33*b* and 33*c*. At a location opposite the lip 16*a*, the rib 33*b* splits into legs 33*d* and 33*e* that define a flat, depressed anvil 34. As best seen in FIG. 9, the ribs 33*a*, 33*b* and 33*c* increase progressively in height the farther a rib is located from the clamp member edge 25.

Figure 10:
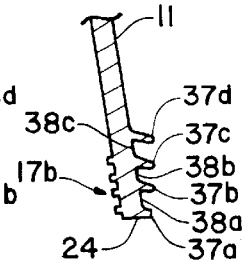
FIG. 10 is a view taken along 10—10 of FIG. 6.

Referring now to FIGS. 4, 6, 8 and 10, it will be noted that, in a manner similar to the case of the clamp member 13, on the inner surface of the upper clamp member 11, a plurality of elongated ribs 37*a*, 37*b*, 37*c* and 33*d* are disposed parallel to the long axis of the clamp member edge 24. The ribs help define troughs 38*a*, 38*b* and 38*c*. The trough 38*a* is located between the ribs 37*a* and 37*b*, the trough 38*b*, which divides into troughs 38*d* and 38*e*, is located between the ribs 37*b* and 37*c* and the trough 38*c* is located between the ribs 37*c* and 37*d*. At a location opposite the lip 16*b*, the rib 37*b* has an angled leg extension 37*e* that joins the rib 37*a*. In a similar manner, the rib 37*c* has an angled leg extension 37*f* that joins the rib 37. The legs 37*e* and 37*f*, together with a lateral wall 33*g*, define a flat, raised and generally triangular region 39. A blade 41, parallel to the clamp member edge 25, is fixed to the region 39. As best seen in FIG. 10, the ribs 37*a*, 37*b*, 37*c* and 37*c* increase progressively in height the farther a rib is located from the clamp member edge 24.

Figure 12:
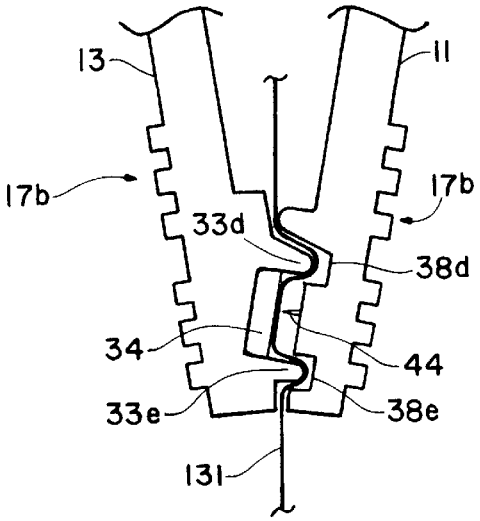
FIG. 12 is a sectional view depicting relationships among the blade, anvil and polymer bag when the clamp of the present invention is utilized to clamp the bag.

The structure of the clamp 10 having been described, the functions of the clamp in bag closing and in bag opening will be considered, with reference to FIGS. 1 and 12–15. In order to clamp the polymer bag 131 closed, the user grasps the bag with one hand and with the other hand, the user separates the clamp members 11 and 13 and slides the clamp 10 over the bag material until the top of the bag abuts the structure 29. At this point the clamp 10 is released and the clamp members 11 and 13, held in a closed condition by the spring 31, securely holds the bag 131. Of course, by reversing the procedure described herein, the user can remove the bag 131 from the clamp 10. The bag clamping function is best seen in FIG. 12 wherein respective ribs and troughs of the clamp members 11 and 13 cooperate in an intercalated manner to hold securely the material of the bag 131. The bag holding function is aided, also, by the blade 41 that acts to urge the bag material against the anvil 34.

Figure 13:
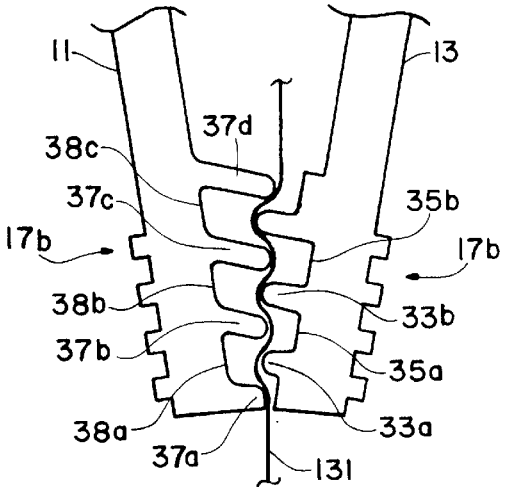
FIG. 13 is a sectional view depicting relationships among the blade, anvil and polymer bag when the clamp of the present invention is utilized to clamp the bag.
Figure 14:
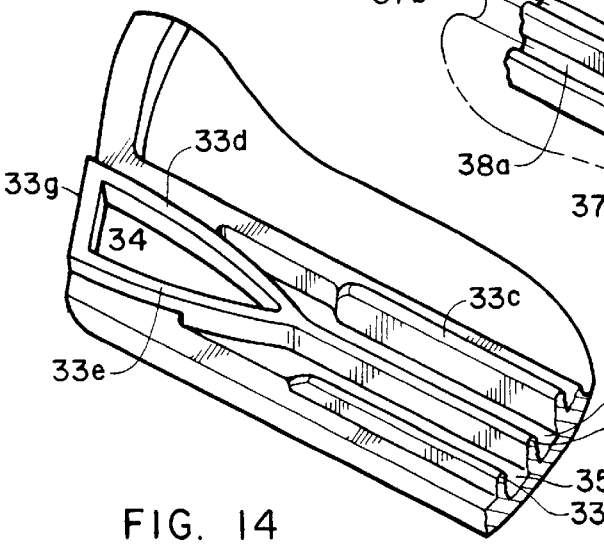
FIG. 14 is a perspective view of the recessed anvil of the present invention.

In summary, the clamp 10 of the present invention closes polymer bags in an efficient and effective manner. This result is achieved because of cooperation among several clamp components. The spring 31, of course, plays an important role in holding the clamp members 11 and 13 in the closed condition. In addition, as best seen in FIGS. 12 and 13, the blade 41, urged by the spring 31 against the flat, recessed anvil 34, aids in holding the bag 131 in position. . While the blade 41 serves to secure the bag within the clamp 10, a blunted top surface of the blade enables the bag to be held without any cutting of bag material. Importantly, the respective ribs and troughs of the clamp members 11 and 13 act in an intercalated fashion to hold the bag 131 securely. The holding function is aided by the smoothly bevelled surfaces of the ribs 33*a*–33*d* and 37*a*–37*d*. In this regard, as best seen in FIG. 13 for example, the rib 37*b* of the clamp member 11 forces a portion of the bag material into the trough 33*b* of the clamp member 13. The other respective intercalated ribs and troughs on the clamp members 11 and 13, serve in a similar manner to increase the surface area of bag material being clamped across the width of the clamp 10. The result is a securely closed bag with very little likelihood of the clamp 10 losing its purchase.

The polymer bag 131 can be released quickly from the clamp 10 by the act of squeezing together the clamp member portions 21*a* and 22*a* while simultaneously removing the bag.

Figure 15:
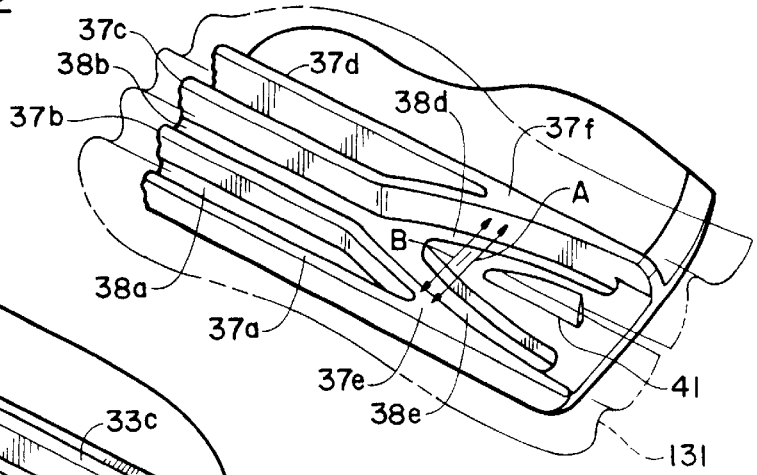
FIG. 15 is a perspective view showing a portion of the ribs and of the blade of the present invention while a polymer bag, shown in phantom, is being cut.

When it is appropriate to open the bag 131, the user grasps the clamp 10 and the bag 131, as shown in FIG. 1. The clamp 10 is placed over the top of the bag until the bag top abuts the structure 29. The user then squeezes together the portions 21*a* and 22*a* of the clamp members 11 and 13, respectively, preferably by squeezing the regions 17*b* together while drawing the clamp 10 across the bag 131. As the bag 131 is drawn toward the triangular region 39 and the blade 41, the bag material is also drawn between the intercalated ribs and troughs, which cooperate in stretching the bag material. In this manner, the bag material is being prepared for cutting by the blade 41. The bag material is at a point of greatest stretching when it enters the region 39 where, as shown in FIG. 15, it is stretched in the directions indicated by the double arrows A and B. Thus prepared, the bag 131 is cut easily by the blade 41 as the bag 131 is moved past the region 39.

It will be evident that there are additional embodiments and applications which are not disclosed in the detailed description but which clearly fall within the scope of the present invention, the specification is, therefore, intended not to be limiting, and the scope of the invention is to be limited only by the following claims.

What is claimed is:

1. A clamp for closing a polymer bag, comprising:

a pair of opposed clamp members wherein said clamp members are movable between a closed and an opened condition, each one of said pair of clamp members having a long axis and an inner and an outer surface;

a hinge attaching said pair of clamp members, said hinge biasing each one of said pair of clamp members into a closed condition; and means disposed on the inner surface of each one of said clamp members for gripping said bag, said gripping means including a blade disposed on the inner surface of one of said pair of clamp members and an opposed recessed anvil, disposed on the inner surface of the other one of said pair of clamp members, whereby said blade is urged against said recessed anvil to help grip said polymer bag, said gripping means further including a plurality of ribs disposed parallel to said long axis and located on the inner surface of each one of said pair of clamp members.

2. The clamp according to claim 1, wherein each one of said pair of clamp members includes a first portion for engagement of a bag surface and a second portion for grasping by a user.

3. The clamp according to claim 2, wherein said clamp member second portions each includes an arcuate shaped edge.

4. The clamp according to claim 2, wherein said clamp member second portions are angled outwardly from one another.

5. The clamp according to claim 1, wherein said hinge is attached to each one of said pair of clamp members at a location between said first portion and said second portion.

6. The clamp according to claim 1, wherein each one of said pair of clamp members includes a lip for aiding in positioning said bag in said clamp.

7. The clamp according to claim 1, including a fence for aiding in positioning said bag in said clamp.

8. The clamp according to claim 1, wherein said blade is disposed adjacent an end of one of said pair of clamp members.

9. The clamp according to claim 1, wherein each one of said clamp members is elongated, each having at least one straight edge.

10. The clamp according to claim 9, wherein each one of said pair of clamp members includes an elongated bearing surface, each one of said bearing surfaces having an axis parallel to the straight edge of its respective clamp member.

11. The clamp according to claim 9, wherein said blade is disposed parallel to the straight edge of one of said pair of clamp members.

12. The clamp according to claim 1, wherein said hinge has a generally U shape and is positioned against the inner surfaces of each one of said pair of clamp members.

13. The clamp according to claim 1, wherein said blade includes a blunted top surface.

14. A device for opening a polymer bag, comprising:

a pair of clamp members wherein said clamp members are movable between a closed and an opened condition, each one of said pair of clamp members having a lip for engagement of a bag surface, each one of said pair of clamp members further having an inner and an outer surface;

a hinge attaching said pair of clamp members, said hinge biasing each one of said pair of clamp members into a closed condition; and bag cutting means disposed on the inner surface of each one of said clamp members for cutting a bag, said cutting means including a blade disposed on the inner surface of one of said pair of clamp members and an opposed recessed anvil, wherein said anvil is disposed on the inner surface of the other one of said pair of clamp members whereby said blade abuts said anvil when said clamp members are moved to a closed condition, said blade including an edge for cutting said bag when said bag is drawn through said device.

15. The device according to claim 14, wherein said blade is disposed adjacent an end of one of said pair of clamp members.

16. The device according to claim 14, wherein each one of said pair of clamp members includes a first portion for engagement of a bag surface and a second portion for grasping by a user.

17. The device according to claim 14, wherein said hinge is attached to each one of said pair of clamp members at a location between said first portion and said second portion.

* * * * *